US008857023B2

(12) United States Patent
Hoffmann

(10) Patent No.: US 8,857,023 B2
(45) Date of Patent: Oct. 14, 2014

(54) APPARATUS FOR REPLACING OR CHANGING A SHAVING BLADE SECURED TO A BLADE HOLDER OF AN ICE RESURFACING MACHINE

(76) Inventor: Michael Hoffmann, Wesel (DE)

( * ) Notice: Subject to any disclaimer, the term of this patent is extended or adjusted under 35 U.S.C. 154(b) by 81 days.

(21) Appl. No.: 13/571,864

(22) Filed: Aug. 10, 2012

(65) Prior Publication Data

US 2013/0036587 A1 Feb. 14, 2013

(30) Foreign Application Priority Data

Aug. 10, 2011 (DE) ..... 10 2011 052 544

(51) Int. Cl.

| | |
|---|---|
| ***B25B 27/14*** | (2006.01) |
| ***A63C 19/10*** | (2006.01) |
| ***E01C 19/22*** | (2006.01) |
| ***E01H 4/00*** | (2006.01) |
| ***E02B 15/02*** | (2006.01) |
| ***E01H 4/02*** | (2006.01) |
| *B25B 11/02* | (2006.01) |
| *B26D 7/26* | (2006.01) |

(52) U.S. Cl.

CPC *B26D 7/26* (2013.01); *E01H 4/023* (2013.01); *B26D 2007/2685* (2013.01)

USPC ..... 29/281.4; 37/219; 299/24

(58) Field of Classification Search

CPC ..... E01H 4/023
USPC ..... 29/281.4
See application file for complete search history.

(56) References Cited

U.S. PATENT DOCUMENTS

| | | | | |
|---|---|---|---|---|
| 3,917,350 | A * | 11/1975 | Bricher | 299/24 |
| 4,705,320 | A * | 11/1987 | Zamboni | 299/24 |
| 5,701,690 | A * | 12/1997 | Miscio | 37/219 |
| 7,124,521 | B1 * | 10/2006 | Medoro | 37/227 |
| 7,364,240 | B2 * | 4/2008 | Seely | 299/24 |
| 7,587,843 | B2 * | 9/2009 | Demers | 37/222 |
| 7,698,837 | B2 * | 4/2010 | Seely | 37/219 |
| 7,765,724 | B2 * | 8/2010 | Walker | 37/219 |
| 2007/0124962 | A1 * | 6/2007 | Buchko | 37/219 |
| 2007/0277360 | A1 * | 12/2007 | Pogorzelski et al. | 29/281.1 |
| 2012/0124795 | A1 * | 5/2012 | Pogorzelski | 29/281.1 |

* cited by examiner

*Primary Examiner* — Lee D Wilson
*Assistant Examiner* — Alvin Grant
(74) *Attorney, Agent, or Firm* — Jennifer S. Stachniak; Robert W. Becker

(57) ABSTRACT

An apparatus for replacing or changing a shaving blade secured or securable to a blade holder beam of an ice resurfacing machine via a plurality of screws, and including a blade carrier. For each of the screws, the blade carrier is provided with a respective fixing element configured to cooperate with a head of that screw. The fixing elements reliably fix these screws in a prescribed position.

18 Claims, 4 Drawing Sheets

APPARATUS FOR REPLACING OR CHANGING A SHAVING BLADE SECURED TO A BLADE HOLDER OF AN ICE RESURFACING MACHINE

The instant application should be granted the priority dates of Aug. 10, 2011, the filing date of the corresponding German patent application 10 2011 052 544.0.

BACKGROUND OF THE INVENTION

The present invention relates to an apparatus for replacing or changing a shaving blade that is secured or securable to a blade holder beam below the shaving carriage of an ice resurfacing machine via a plurality of screws.

Without such an apparatus the disassembly of a worn-out shaving blade, as well as the remounting of a new or freshly sharpened blade, on such an ice resurfacing machine is very time consuming and is extremely difficult and dangerous.

With ice resurfacing machines, the shaving blade is generally securely screwed below the shaving carriage. The spacing of the blade relative to the workshop floor when the shaving carriage is raised is generally about 200 mm. The distance of the blade to the rear edge of the shaving carriage is generally about 400 mm. Present for the securement of the blade, as part of the ice resurfacing machine, is a blade holder beam to which the blade is secured, in particular via countersunk or slotted flat-head screws, which via the flat head are inserted from below through the blade and the blade holder beam, and are secured from above by means of a nut. Multicornered, countersunk socket head screws, such as hexagonal socket screws, are generally used as the screws.

For the changing of the blade, the mechanic, who is on his knees, must grasp from behind the shaving carriage and below the shaving carriage, must from below fix with a screw driver, for example a hollow screw driver, the socket screws that are screwed in about 400 mm ahead of the rear edge of the carriage, and at the same time must loosen the tightened nuts that are disposed about 400 mm ahead of the rear edge of the carriage of the ice resurfacing machine and about 300 mm below the upper edge of the shaving carriage.

Prior to loosening the screws in order to remove the blade, the blade must be fixed on both sides by lowering the shaving carriage onto beams, generally wooden beams. After all of the screws have been removed, the shaving carriage is again raised, and the blade that is disposed on the beams must be pulled out and placed upon an available blade protector.

The sharpened new blade is subsequently placed upon the wooden beams and is shoved together with the wooden beams approximately into position below the shaving carriage, which must subsequently again be lowered to the required height in order to be able to guide the blade screws through the blade and the blade carrier.

US 2007/0277360 discloses an apparatus for changing ice scraper blades that are fastened or may be fastened by screws to a blade holder beam of an ice resurfacing machine. Mounted on opposite ends of the base frame of the ice resurfacing machine are two caster wheels upon which the base frame can be rolled over a horizontal ice surface or floor. A flat or shallow lift can be used for the placement, lowering, raising, and moving back and forth of the blade.

Other devices for changing ice scraper blades of ice resurfacing machines are known from U.S. Pat. No. 3,917,350 and CA 2,643,560.

It an object of the present invention to provide an improved blade-changing apparatus with which the necessary mounting work can be effected more rapidly, and in particular the loosening and also the mounting of the blade can be effected almost without any danger from the upper side of the shaving carriage without the mechanic having to kneel down and grasp below the shaving carriage, thereby also entirely avoiding any contact with the shaving blade.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

To inventively realize the aforementioned object, for each screw the blade carrier is provided with a respective fixing element that cooperates with a head of that screw, wherein the fixing elements reliably fix the screws in a prescribed position.

A metal rail is advantageously provided as a blade carrier, which, preferably with the aid of two handles, can in a simple manner be disposed below the shaving blade in such a way that all of to the blade screws are or can be simultaneously fixed against rotation by a respective fixing element that cooperates with the screw head in order to be able to loosen the nuts. The blade and the screws are held by the blade carrier even after the nuts have been removed.

Further specific features of the present application will be described in detail subsequently.

DESCRIPTION OF SPECIFIC EMBODIMENTS

Figure 1:
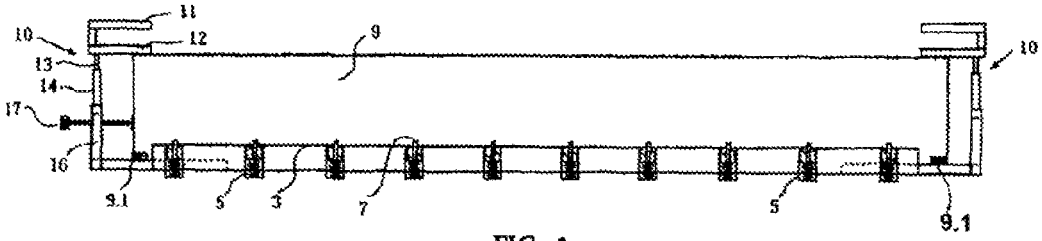
FIG. 1 is a front view of the inventive apparatus in association with the shaving carriage of an ice resurfacing machine.

Referring now to the drawings in detail, FIG. 1 shows a machine frame in the form of a shaving or scraping sledge or carriage 9 as part of a non-illustrated ice resurfacing machine, also known as an ice resurfacer. Mounted on opposite ends of the shaving carriage 9 are sledge or carriage runners 9.1 upon which the shaving carriage 9 can be moved over a horizontal ice surface or floor.

Figure 6:
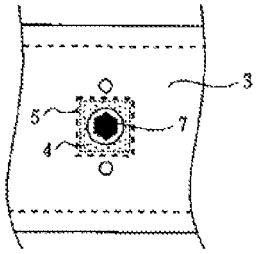
FIG. 6: is sectional view taken along the line VI-VI in FIG. 5.

The inventive blade changing apparatus (see also FIGS. 2 to 6) includes a metal rail that forms a blade carrier 3 and that has, for example, ten fixing bolts or pins 7 that are spring-mounted and are secured against twisting or turning; the fixing pins 7 serve to fix ten screws 8, via which the ice scraper or shaving blade 2 is secured to the cutter bar or blade holder beam 1 of the ice resurfacing machine by means of nuts 8.2 that are threaded onto the screws 8. Mounted on the blade carrier 3 for each screw 8 is a housing 5 that has a non-circular, in particular multi-cornered, and preferably four-cornered, housing chamber (see FIG. 6). Axially displaceably guided in each housing chamber is a pin holder 4, the cross-sectional area of which is adapted to the inner cross-section of the housing 5. A fixing bolt or pin 7, which is secured against rotation and against axial displacement, is inserted into each pin holder 4; one end of the fixing pin 7 is provided with an end portion that can be inserted into a receiving opening 8.1 of a screw 8. The shaving blade 2 is provided with a hard metal layer 2.1 that forms the cutting edge.

Depending upon the type of screw that is used, preferably a screw having a hexagonal recessed hole, the fixing pin 7 has, for example, the shape of a hexagonal screw driver. In principle, the end portion of the fixing pin 7 can be embodied as a screw driver for, in particular, double six, triangular, square, slotted, cross-slotted or Philips, torx, or even specially made screws.

Each fixing pin 7 is spring-loaded in the axial direction by means of a compression spring 6, which is preferably supported between the base of the housing 5 and the pin holder 4, in such a way that when the apparatus is being used, the fixing pin 7 is pressed from below against the screw 8 that is associated with that pin 7. The compression spring 6 can also be replaced by an appropriate permanent magnet arrangement.

Figure 2:
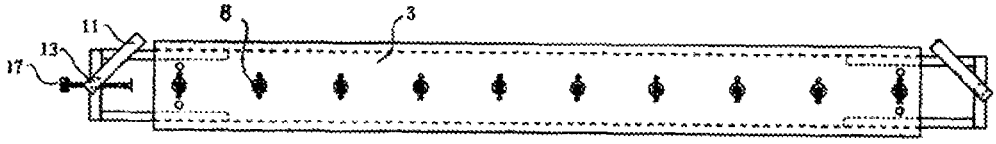
FIG. 2 is a plan view onto the inventive apparatus.
Figure 3:
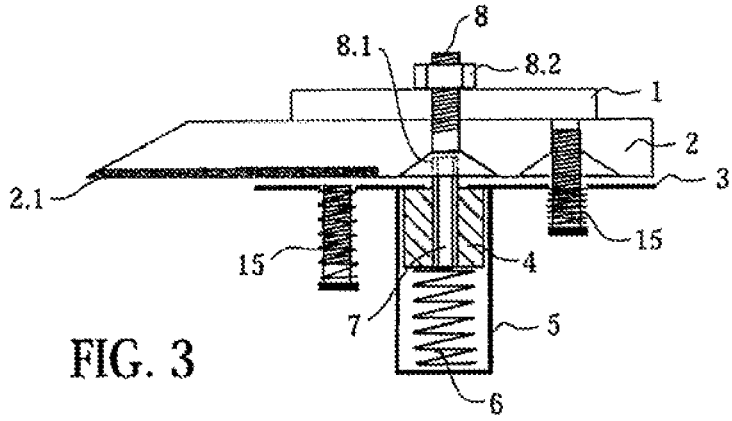
FIG. 3: is a partially sectioned side view of the inventive apparatus in association with the blade holder beam of an ice resurfacing machine, with a new shaving blade being securely screwed to the blade holder beam.
Figure 4:
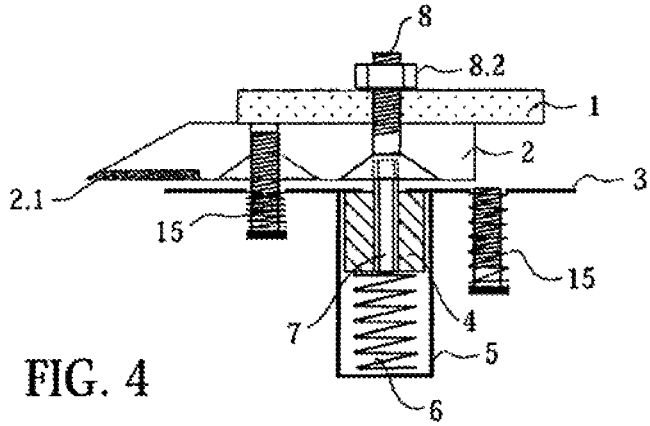
FIG. 4: is an illustration corresponding to that of FIG. 3 but having a shaving blade that is shorter due to frequent sharpening.
Figure 5:
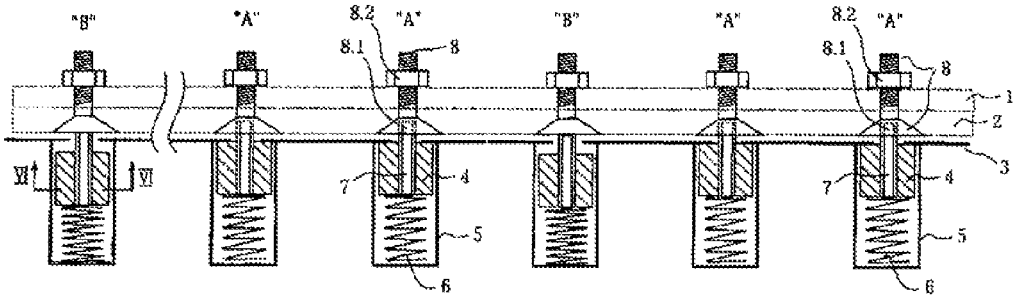
FIG. 5: is an enlarged, partially sectioned front view of the inventive apparatus associated with a blade holder beam.

As shown in FIGS. 1 and 2, for mounting the blade carrier 3 on the blade holder beam 1 of an ice resurfacing machine in a manner that ensures precise positioning, securing devices 10 are disposed in the region of the two ends of the blade carrier 3. Each securing device 10, which is preferably displaceable and fixable in the longitudinal direction of the blade carrier 3, includes a spring-loaded clamping element 12 that is telescopically adjustable in height perpendicular to the blade carrier 3; as can be seen in FIGS. 1 and 2, the clamping element 12, together with a handle 11, is pivotable about an axis that is disposed perpendicular to the blade carrier 3.

Figure 7:
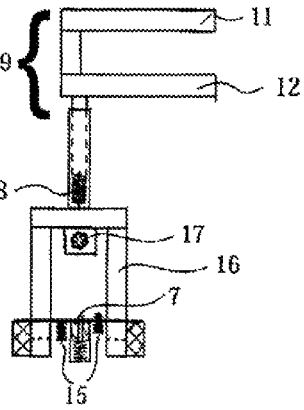
FIG. 7: is a partially sectioned side view of a securing device for the mounting or clamping of the apparatus onto an ice resurfacing machine.
Figure 8:
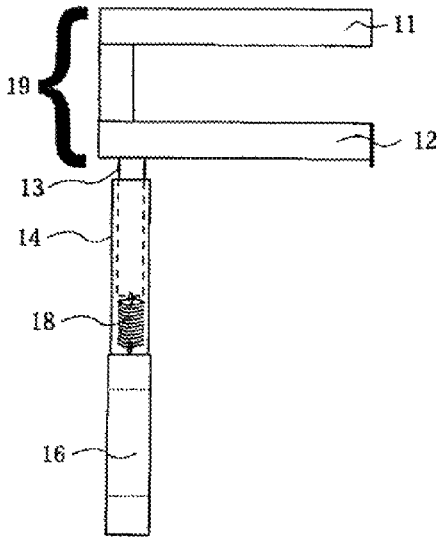
FIGS. 8 & 9 are side views of the securing device in a state of rest (FIG. 8) and in a working state (FIG. 9).
Figure 9:
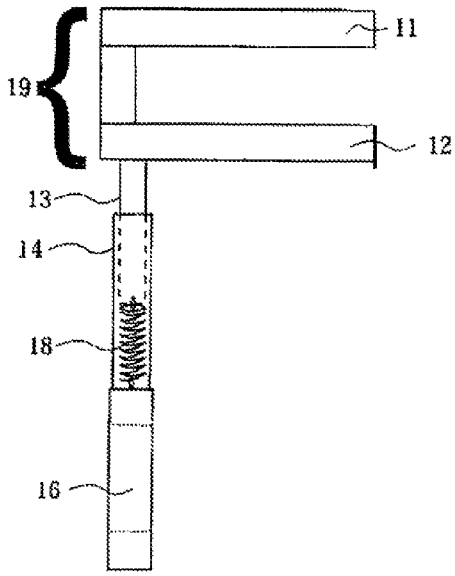

As can be seen in FIGS. 7 to 9, the unit 19, which includes the clamping element 12 and the handle 19, is secured to a telescopic rod 13, which is guided in a telescopic tube 14. Secured between the lower end of the telescopic tube 14 and a frame 16 is a tension spring 18, so that the unit 19 is spring-loaded toward the bottom.

As can be seen in FIGS. 1 and 2, an adjusting element, preferably in the form of a set screw 17, is mounted on the frame 16 in order to be able to laterally position the inventive blade-changing apparatus during mounting on the ice resurfacing machine in such a way that the fixing pins 7 are disposed exactly across from the receiving openings 8.1 of the screws 8.

If for removal of a shaving blade that has become dull the inventive blade-changing apparatus is mounted or, by means of the securing devices 10, is clamped on the ice resurfacing machine, the fixing pins 7 can either be disposed aligned opposite the receiving openings 8.1 of the screws 8, so that pursuant to the positions "A" (see FIG. 5) the fixing pins 7 can immediately register in the receiving openings 8.1 of the screws 8 thereby fixing or securing the screws against rotation, or pursuant to the positions "B" the fixing pins 7 can be non-aligned with the receiving openings 8.1 so that the screws 8 are not secured against rotation.

If in the case of position "B" the corresponding nuts 8.2 are to be loosened, the screw 8 is first rotated therewith until the fixing pin 7 and the receiving opening 8.1 of the screw 8 are disposed opposite one another in an aligned manner, so that the fixing pin 7 is pressed upwardly by the compression spring 6 into the receiving opening 8.1, thereby fixing or securing the screw 8 against rotation.

The inventive blade-changing apparatus is preferably mounted on rollers, for example by mounting on each side a roller pair that is respectively pivotable about 360°.

To change the blade, the shaving carriage 9 of the ice resurfacing machine is raised approximately 100 mm above the ground. With the aid of the customary blade adjustment device of the ice resurfacing machine, the shaving blade is then placed out of the working position and into that position where it is horizontal to the ground. The blade-changing apparatus is thereupon rolled from behind transversely below the shaving carriage 9 until the blade cutter beam 1 is disposed below the shaving blade. Subsequently, with the aid of the spring-loaded handle 11 the blade carrier 3 is successively raised on both sides until it comes to rest against the shaving blade, in connection with which one must pay attention that the blade carrier 3, by means of the guide pins 15 and the lateral set screw 17, is oriented exactly below the shaving blade 2 that is securely bolted to the blade holder beam 1, and hence the fixing pins 7 are disposed below the screws 8. The unit 19, composed of the handle 11 and the clamping element 12, is pulled upwardly against the force of the tension spring 18 and is pivoted out of the pivot position illustrated in FIG. 2 into the position illustrated in FIG. 1, and is again released, so that the unit 19 can again be pulled downwardly by the tension spring 18, as a consequence of which the clamping element 12 comes to rest against the upper side of the shaving carriage 9, and the inventive blade-changing apparatus is situated on the shaving carriage 9 in a precise position.

The nuts 8 are subsequently loosened with a ratchet or drive tool, or some other appropriate tool, and are placed upon the blade holder beam 1 in the vicinity of the screws.

The two handles 11 are thereafter again subsequently raised and are pivoted into the pivot position illustrated in FIG. 2 in order to be able to lower the blade carrier 3, with the "used" blade resting thereon, and to be able to roll it behind the shaving carriage 9.

The used or worn out blade, preferably with the aid of two magnetic holding devices, is subsequently raised from the blade carrier 3 and placed upon an available blade protector. In this connection, the individual screws 8 remain upon the fixing pin 7 and the blade carrier 3. The new or sharpened blade, again with the aid of the magnetic holding devices, can then be placed upon the blade carrier 3 and the screws 8. Subsequently, the blade-changing apparatus, with the shaving blade 2 resting upon the blade carrier 3, is rolled below the shaving carriage 9 in such a way that the blade screws 8 are placed below the holes in the blade holder beam 1 of the ice resurfacing machine. The blade-changing apparatus is then raised by means of the securing devices 10 so that the screws 8 pass through the holes in the blade holder beam 1. The blade-changing apparatus is thereupon secured to the shaving carriage 9 by means of the unit 19. Subsequently, the nuts 8.2 are placed upon the screws 8 from above, and are tightened by means of a ratchet or drive tool or other appropriate tool.

After pivoting the unit 19 into the pivot position illustrated in FIG. 2, the inventive blade-changing apparatus can again be lowered and rolled away from its position below the shaving carriage 9.

The specification incorporates by reference the disclosure of German priority document 10 2011 052 544.0 filed Aug. 10, 2011.

The present invention is, of course, in no way restricted to the specific disclosure of the specification and drawings, but also encompasses any modifications within the scope of the appended claims.

What I claim is:

1. An apparatus for replacing or changing a shaving blade secured or securable to a blade holder beam of an ice resurfacing machine via a plurality of screws, comprising:

a blade carrier, wherein for each of said screws, said blade carrier is provided with an axially displaceable fixing pin, further wherein each fixing pin has at one end an end portion that is insertable into a receiving opening of a respective one of said screws, and wherein each of said fixing pins is loaded by a respective spring in such a way that during use of said apparatus said fixing pin is pressed against an associated one of said screws by means of said spring.

2. The apparatus according to claim 1, which, for each of said fixing pins, includes a housing mounted on said blade carrier, and also includes a pin holder disposed in said housing, wherein each of said fixing pins is unmovably disposed in said bolt holder, and wherein said bolt holder, while being secured against rotation, is axially displaceable and spring-loaded in said housing such that during use of said apparatus said fixing pin is pressed against an associated one of said screws.

3. The apparatus according to claim 2, wherein said pin holder has a non-round cross-sectional area, and wherein said housing has a receiving chamber with a correspondingly adapted cross-sectional area.

4. The apparatus according to claim 3, wherein each of said pin holders has a multi-cornered cross-sectional area.

5. The apparatus according to claim 1, wherein each of said fixing pins is spring-loaded by means of a compression spring.

6. The apparatus according to claim 1, wherein each of said fixing pins is spring-loaded by means of magnetic force.

7. The apparatus according to claim 1, wherein each of said fixing pins has the shape of a multi-cornered screw driver, such as a hexagonal screw driver.

8. The apparatus according to claim 1, wherein said end portion of each of said fixing pins is embodied as a screw driver for hexagonal, double six, triangular, square, slotted, cross-slotted or Philips, torx or specially made screws.

9. The apparatus according to claim 1, which includes a respective securing device disposed at opposite ends of said blade carrier for a correctly positioned mounting of said blade carrier on the ice resurfacing machine.

10. The apparatus according to claim 9, wherein the ice resurfacing machine includes a shaving carriage, and wherein said blade carrier is configured to be mounted on said shaving carriage by means of said securing devices.

11. The apparatus according to claim 10, wherein each of said securing devices is displaceably and fixedly mounted on said blade carrier, and wherein each of said securing devices is provided with a spring-loaded clamping element that is telescopically adjustable in height perpendicular to said blade carrier.

12. The apparatus according to claim 11, wherein each of said securing devices is displaceable in a longitudinal direction of said blade carrier and is configured for support on said shaving carriage of the ice resurfacing machine.

13. The apparatus according to claim 11, wherein each of said securing devices further includes a handle, and wherein said clamping element and said handle are pivotable about an axis that is disposed perpendicular to said blade carrier.

14. The apparatus according to claim 9, wherein at least one of said two securing devices is provided with an adjusting element for a lateral positioning of said securing device, and hence of said blade carrier, relative to the ice resurfacing machine.

15. The apparatus according to claim 14, wherein said adjusting element is in the form of a set screw.

16. The apparatus according to claim 1, wherein in the region of at least one of two ends said blade carrier has threaded therein two spaced-apart guide pins such that a respective one of said guide pins is configured to engage in a respective lateral hole of an unused row of holes in said shaving blade in the vicinity of an edge thereof.

17. The apparatus according to claim 1, wherein blade grips provided with permanent magnets are provided for raising said shaving blade from, and for placing said shaving blade upon, said blade carrier.

18. The apparatus according to claim 1, wherein rollers are provided, and wherein said blade holder is mounted on said rollers.

* * * * *